US008641541B2

(12) United States Patent
Kitchen

(10) Patent No.: US 8,641,541 B2
(45) Date of Patent: Feb. 4, 2014

(54) NARROW BASE VIEWING WHEEL

(76) Inventor: William J. Kitchen, Windermere, FL (US)

( * ) Notice: Subject to any disclaimer, the term of this patent is extended or adjusted under 35 U.S.C. 154(b) by 0 days.

(21) Appl. No.: 13/640,302

(22) PCT Filed: Sep. 23, 2011

(86) PCT No.: PCT/US2011/053126

§ 371 (c)(1),
(2), (4) Date: Oct. 9, 2012

(87) PCT Pub. No.: WO2012/040647

PCT Pub. Date: Mar. 29, 2012

(65) Prior Publication Data

US 2013/0029773 A1 Jan. 31, 2013

Related U.S. Application Data

(60) Provisional application No. 61/385,921, filed on Sep. 23, 2010.

(51) Int. Cl.
*A63G 27/06* (2006.01)
*A63G 27/02* (2006.01)

(52) U.S. Cl.
USPC ..... 472/44

(58) Field of Classification Search
USPC ..... 472/3, 27, 39, 43, 44, 45, 46, 47, 136; 104/53, 124, 125
See application file for complete search history.

(56) References Cited

U.S. PATENT DOCUMENTS

| | | | | | |
|---|---|---|---|---|---|
| 1,935,558 | A | * | 11/1933 | Haskell | 472/22 |
| 2,082,287 | A | * | 6/1937 | Hermann | 472/45 |
| 2,109,539 | A | * | 3/1938 | Kornsweet | 472/44 |
| 3,002,753 | A | * | 10/1961 | Garbrick | 472/3 |
| 3,552,747 | A | * | 1/1971 | Deem | 472/3 |
| 4,988,089 | A | * | 1/1991 | Knijpstra | 472/3 |
| 5,188,566 | A | * | 2/1993 | Bohme | 472/45 |
| D400,616 | S | | 11/1998 | Gnezdilov | |
| 6,402,624 | B1 | | 6/2002 | Larson et al. | |
| 6,872,144 | B2 | * | 3/2005 | Kroon et al. | 472/45 |

(Continued)

FOREIGN PATENT DOCUMENTS

| | | |
|---|---|---|
| DE | 10 2007 051 085 A1 | 7/2009 |
| EP | 0 389 008 A1 | 9/1990 |

(Continued)

OTHER PUBLICATIONS

International Search Report in international application No. PCT/US2011/053126 mailed Apr. 27, 2012.

(Continued)

*Primary Examiner* — Kien Nguyen
(74) *Attorney, Agent, or Firm* — Margaret Polson; Abigail Smith; Oppedahl Patent Law Firm LLC

(57) ABSTRACT

A wheel amusement ride is depicted, which moves carriages containing riders around the wheel on a track. In other words, the carriages move, not the wheel. This design allows a moment frame to be used to support the wheel. Because a moment frame can be constructed to be much narrower than the supports for a traditional Ferris wheel, the wheel of the present invention can be installed in a much narrower land area, while still achieving great height.

11 Claims, 13 Drawing Sheets

(56) References Cited

U.S. PATENT DOCUMENTS

| | | | |
|---|---|---|---|
| 6,994,629 | B2 | 2/2006 | Bussink |
| 7,686,697 | B2 | 3/2010 | Bussink |
| D656,213 | S | 3/2012 | Kitchen |
| D668,309 | S | 10/2012 | McLaren |
| 2007/0113753 | A1 | 5/2007 | Meindl et al. |
| 2007/0261589 | A1 | 11/2007 | Bussink |
| 2009/0075740 | A1 | 3/2009 | Kojro |

FOREIGN PATENT DOCUMENTS

| | | | |
|---|---|---|---|
| GB | 21137 | | 0/1911 |
| GB | 22781 | | 0/1910 |
| JP | 2000-070554 | A | 3/2000 |
| JP | 2001-104653 | A | 4/2001 |
| JP | 2002-102544 | A | 4/2002 |
| JP | 2002-159758 | A | 6/2002 |
| JP | 2002-273063 | A | 9/2002 |
| JP | 2002-355446 | A | 12/2002 |
| JP | 2002-360940 | A | 12/2002 |
| JP | 2003-024647 | A | 1/2003 |
| JP | 2003-210853 | A | 7/2003 |
| JP | 2003-275471 | A | 9/2003 |
| JP | 2005-139834 | A | 6/2005 |
| JP | 2007-105353 | A | 4/2007 |
| JP | 2007-167215 | A | 7/2007 |
| JP | 2008-246160 | A | 10/2008 |
| JP | 2009-148570 | A | 7/2009 |
| WO | 00/29086 | A1 | 5/2000 |
| WO | 00/41789 | A1 | 7/2000 |

OTHER PUBLICATIONS

Written Opinion in international application No. PCT/US2011/053126 mailed Apr. 27, 2012.

* cited by examiner

NARROW BASE VIEWING WHEEL

CROSS REFERENCE APPLICATIONS

This application is a non-provisional application claiming the benefits of provisional application No. 61/385,921 filed Sep. 23, 2010, which is incorporated by reference for all purposes. This application also incorporates by reference international application no. PCT/US10/47986 in its entirety.

BACKGROUND

Traditional Ferris wheels require a large ground area due to the size and required configuration of the support structure once they are built taller than 15 to 30 meters (50 or 100 feet). This required structure has prevented erection of tall Ferris wheels for use as viewing wheels in areas having limited space.

The foregoing example of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

A structural system is disclosed which can fully support a viewing of a height of greater than about 60 meters (200 feet) wheel utilizing a much narrower frame.

The wheel incorporates a track on which rider carriages run. The wheel itself does not turn.

As the wheel does not turn as most prior art wheel others do, a moment frame with diagonal bracing can intertwine with the cable spokes to form a support system from the ground that will resist lateral overturning forces in a very efficient manner. This will allow this wheel to be installed in a narrow site with a width dimension of only 25 to 26 meters (85 feet), while still reaching a height of 152 meters (500 feet). Installation can be achieved without altering the surrounding environment, such as by removing existing structures. No other observation wheel with a similar height to width ratio can be installed economically.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
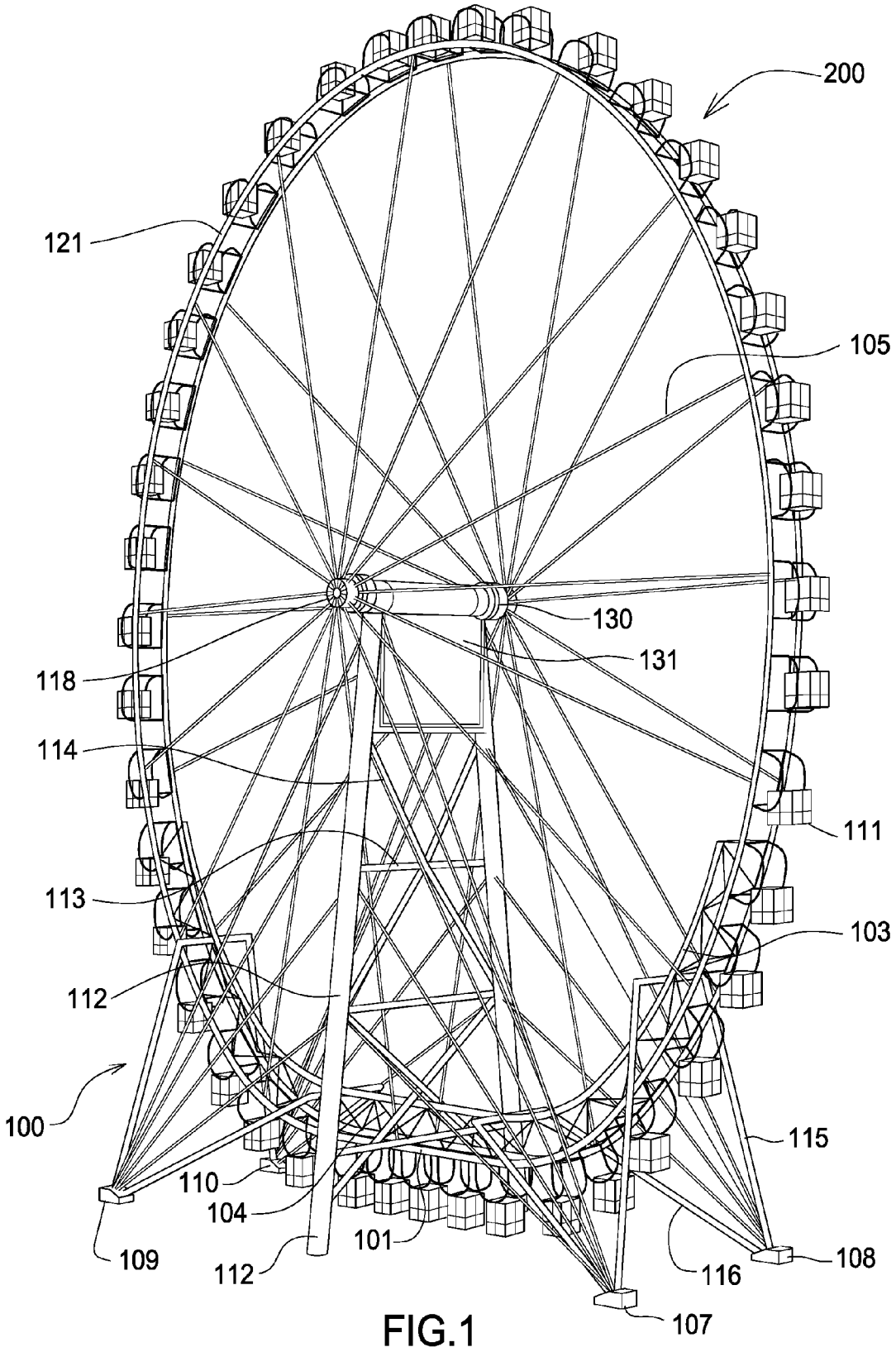
FIG. 1 is a perspective view of one embodiment of the narrow base viewing wheel.
Figure 2:
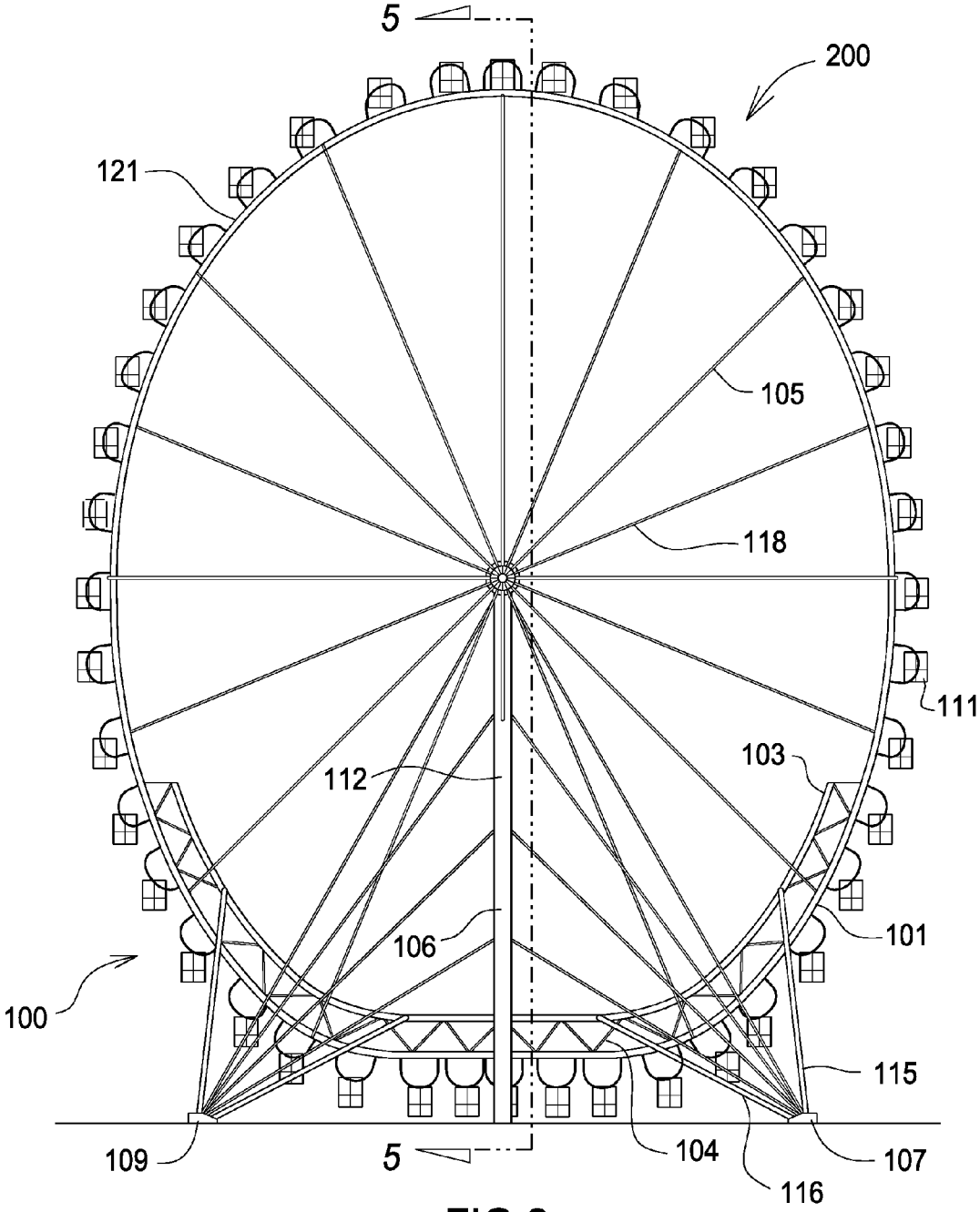
FIG. 2 is front elevation view of the narrow base viewing wheel.
Figure 3:
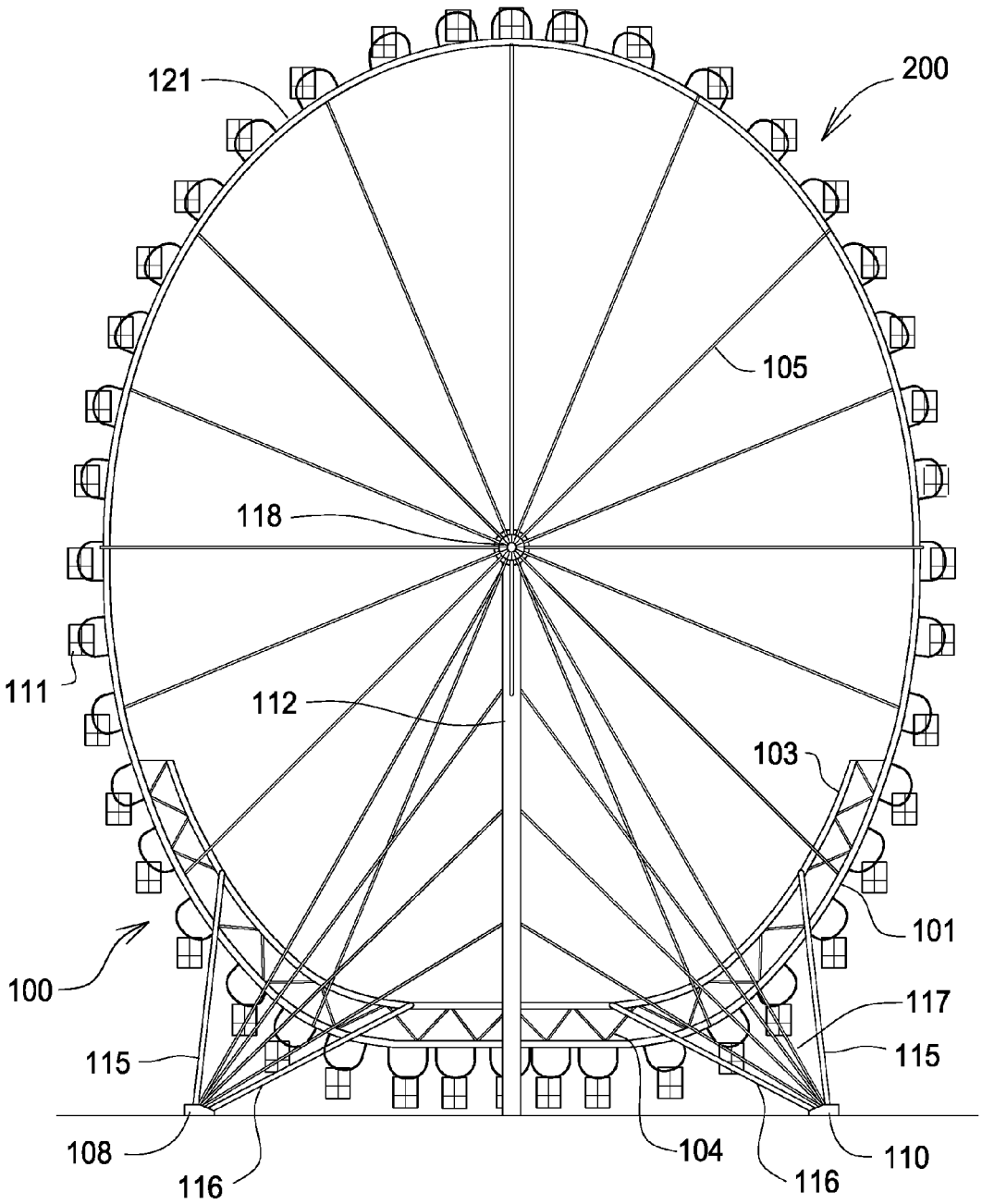
FIG. 3 is a rear elevation view of the narrow base viewing wheel.
Figure 4:
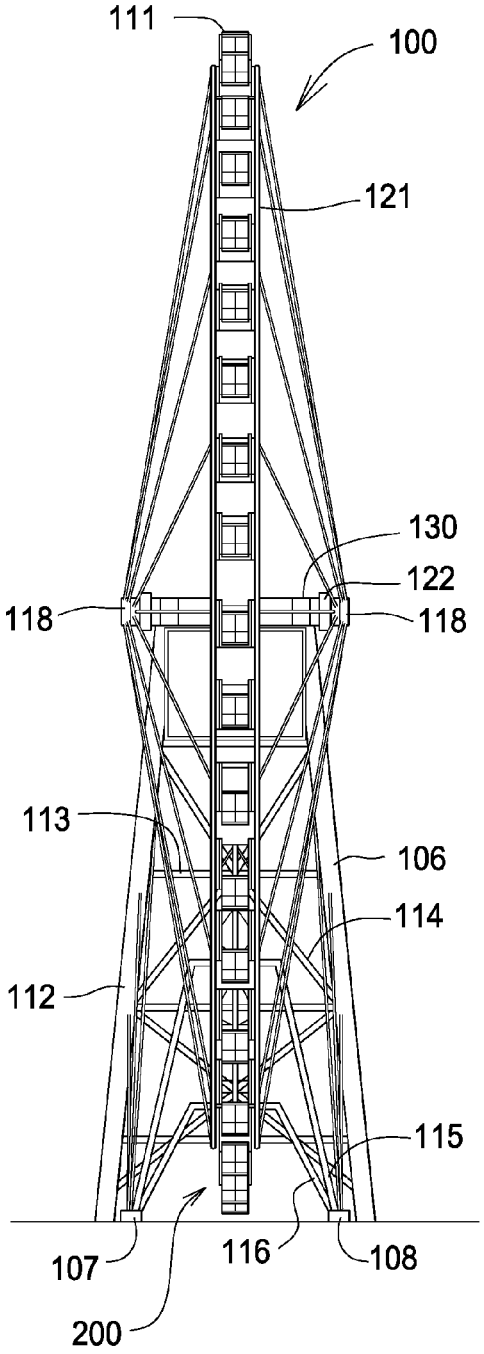
FIG. 4 is a left side elevation view of the narrow base viewing wheel.
Figure 5:
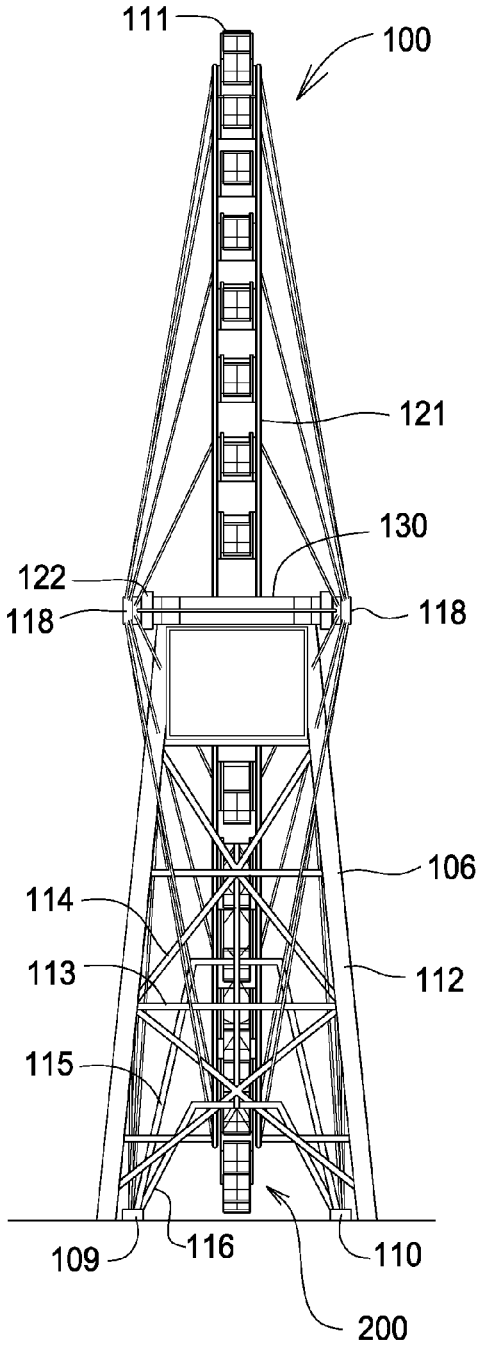
FIG. 5 is a cross sectional view of the narrow base viewing wheel along line 5-5.

Referring first to FIGS. 1-8, an amusement ride 100 is shown. Amusement ride 100 includes two carriage rails 101, 102, which together form a track 121. The track can be between 57 to 244 meters (200 to 800 feet) in total height. In the lower portion of the track a third rail 103 is added for additional support and rigidity. Third rail 103 is approximately equidistant between carriage rails 101, 102 in the depicted embodiment. Third rail 103 extends upward along the track 121 approximately 10% to 30% of the overall height of the amusement ride 100, functioning as a support rail. In the depicted embodiment, third rail 103 substantially parallels approximately 30% of the inner circumference of amusement ride 100. In the depicted embodiment, third rail 103 is between approximately 100 feet and approximately 300 feet in length. In the depicted embodiment, carriage rails 101, 102 and third rail 103 are made of steel. While steel is depicted, any material having similar strength and rigidity could be used. As can be seen in FIG. 1, signage 131 can be placed between the columns 112.

Braces 104 attach carriage rails 101, 102 and third rail 103 together. In the depicted embodiment braces 104 are made of steel. In the depicted embodiment, braces 104 are welded to carriage rails 101, 102 and third rail 103. The gauge of steel may be varied depending on the height of amusement ride 100. Braces 104 can vary in length from approximately 3 meters (10 feet) to approximately 10 meters (30 feet), depending on the height of amusement ride 100. The number of braces 104 is also variable, depending on the height of the wheel. In the depicted embodiment, braces 104 are arranged in a triangular configuration. While other configurations could be used, a triangular configuration is the most efficient configuration for providing strength. The third rail 103 and braces 104 function as a support rail to stiffen the track 121 and support the weight of the whole wheel 200.

Connection cables 105 attach to beam 130 of center frame 106 at hubs 118 attach the track 121. The connection cables 105 are under tension to hold and support the structure. Collar 122 serves as an attachment point for connection cables 105. In the depicted embodiment, connection cables 105 are made of 1" to 3" gauge steel. The number of connection 105 cables can vary between 36 and 72, depending on the size of amusement ride 100. Connection cables 105 attach to hub 118 and carriage rails 101, 102 via compressed fittings attached to connection cables 105, which are bolted to hub 118 and carriage rails 101, 102. Hub 118 is made of steel. Hub can be between approximately 3 meters (10 feet) and 10 meters (30 feet) diameter, depending on the size of wheel 200.

The combination of third rail 103, ground anchors 107, 108, 109, 110, bars 115, 116 and stay cables 117 hold the carriage track 121 in a substantially vertical position and allow enough room between the carriage track 121 and the ground for rider carriages 111 to move freely. With the center frame 106 they form the sole support of the ride, eliminating the standard guy wires or other bracing extending from the sides of the ride. Ground anchors 107, 108, 109, 110 attach to support rail 103 through bars 115, 116. The shape of ground anchors 107, 108, 109, 110 allows for compression and overturning moments from amusement ride 100. Stay cables 117 attach to ground anchors 107, 108, 109, 110 at one end and center frame 106 at the other. Each stay cable 117 is attached to center frame 106 at a point that provides maximum structural strength. Using a prior art design of stay cables a stationary track view ride that is approximately 152 meters (500 feet) tall would require a ground footprint of approximately 61 meters by 91 meters (200 feet by 300 feet). Using the disclosed narrow base design approximately 152 meters (500 feet) tall ride can be placed in a ground footprint of about 25 to 61 meters (80 feet by 200 feet), allowing much greater flexibility in the placement of such viewing wheels.

Ground anchors 107, 108, 109, 110 can be between approximately 15 to 46 meters (50 feet and 150 feet) from center frame 106, depending on local conditions and size of wheel. The distance between ground anchors 107, 108, 109, 110 and center frame 106 is proportionate to the size of wheel 200. Ground anchors 107, 108, 109, 110 are made of steel and concrete. Bars 115, 116 can range from a length of approximately 20 feet to 60 feet, depending on the size of wheel 200. Bar 115 can be at an angle of approximately 5 to 15 degrees to the ground. Bar 116 can be at an angle of approximately 30 to 45 degrees to the ground. These angles are designed for maximum stability. Bars 115, 116 are made of 6 to 18"steel. In the depicted embodiment, stay cables 117 are made of 1 to 3" diameter steel wire rope cables in the depicted embodiment. While the depicted embodiment features four stay cables 117 from each ground anchor 107, 108, 109, 110 to center frame 106, the number of stay cables is variable.

Figure 6:
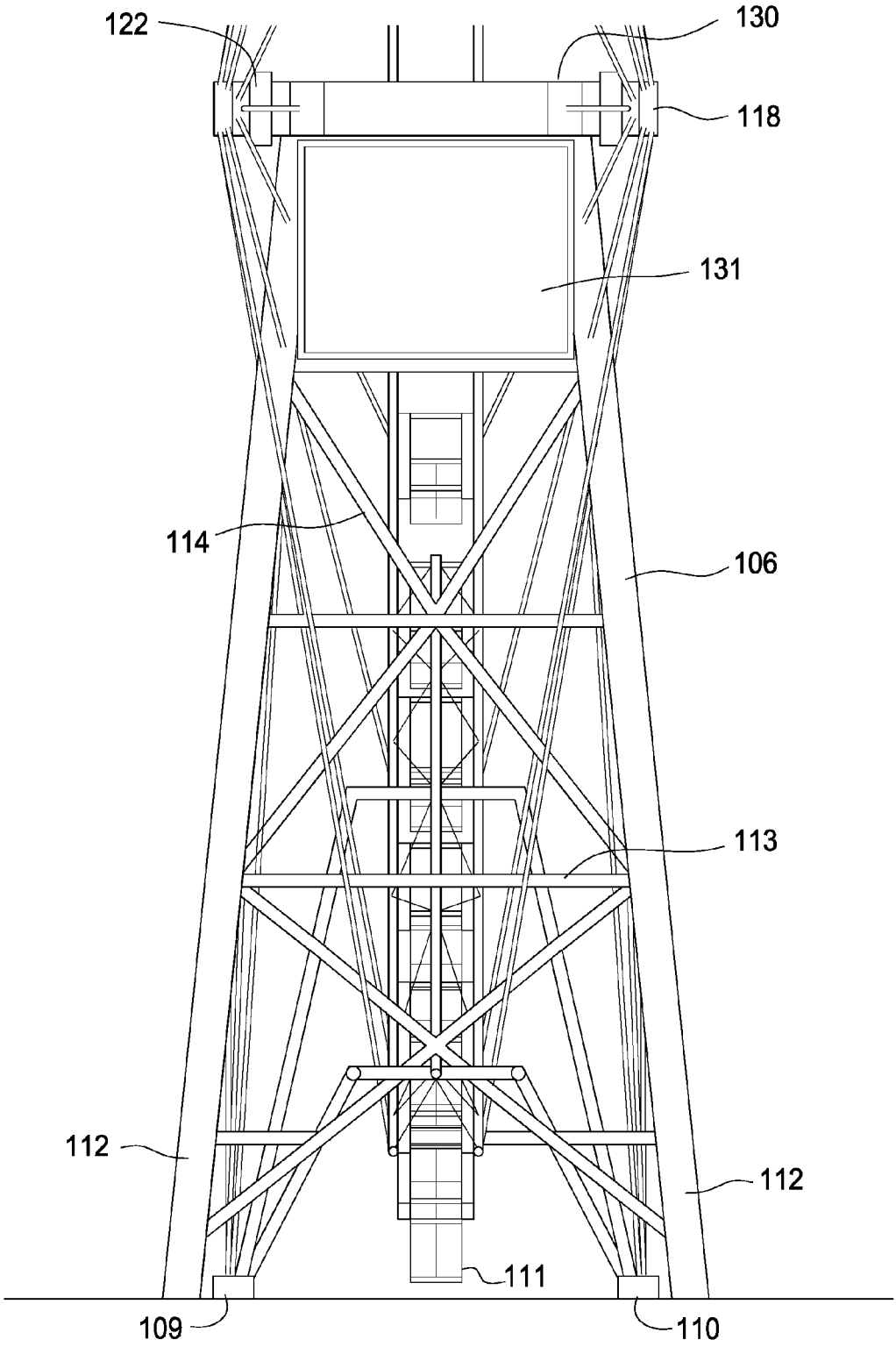
FIG. 6 is an elevation view of the support structure for the narrow base viewing wheel.

FIG. 6 provides the most detailed views of center frame 106. Center frame 106 is comprised of columns 112 attached to top beam 130 and beams 113 and diagonal braces 114 between the columns 112. Center frame 106 is a moment frame, wherein frame 106 both supports the vertical load of the carriage rails 101, 102, and rider carriages 111 and resists lateral forces, such as wind. The lateral resistance in center frame 106 is provided by diagonal braces 114 and rigid joinder of beams 113 to columns 112. Center frame 106 is attached to hubs 118 on top beam 13. Connection cables 105 attach to hubs 118 on both sides of the top beam 130 to achieve additional stability. The ground anchors 107, 108, 109, 110 attached to the support rail 103 provide the stability for the support track in the other two directions (side to side) in addition to the center frame 106 support in the lateral directions. As seen in FIG. 6, the ground anchors are inside the width of the columns 112 at the base of the columns. In most embodiments the base of the columns 112 is the widest part of the ride, a significant change from the prior art. This combination of supports function to hold the support track stable in all directions of movement on a very narrow base. As can be seen in FIG. 1, signage 131 can be placed between the columns 112.

In the depicted embodiment, columns 112 are between 1 to 4 meters (3 to 12 feet) in diameter. The columns 112 can be filled with concrete for additional stability. Beams 113 are 1 to 3 feet in diameter and diagonal braces 114 are all sixed appropriate for the load being supported. While four beams 113 and four braces 114 or shown, either more or less of each could be used. The depicted configuration achieves maximum stability with minimum cost. Diagonal braces 114, beams 113 and columns 112 can be attached to one another via welding or bolts.

Figure 7:
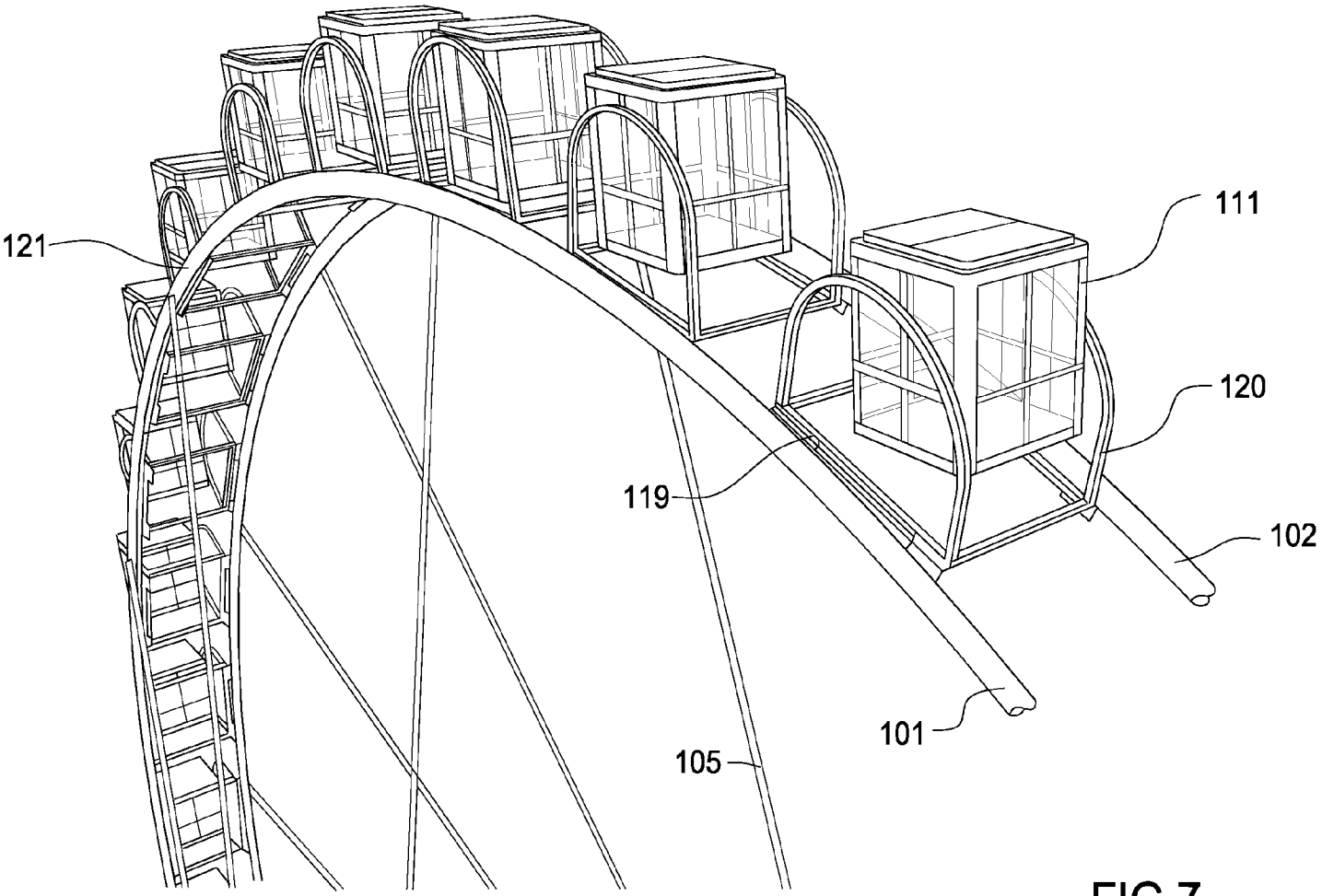
FIG. 7 is a perspective view of a top side of the viewing wheel with the rider carriages.
Figure 8:
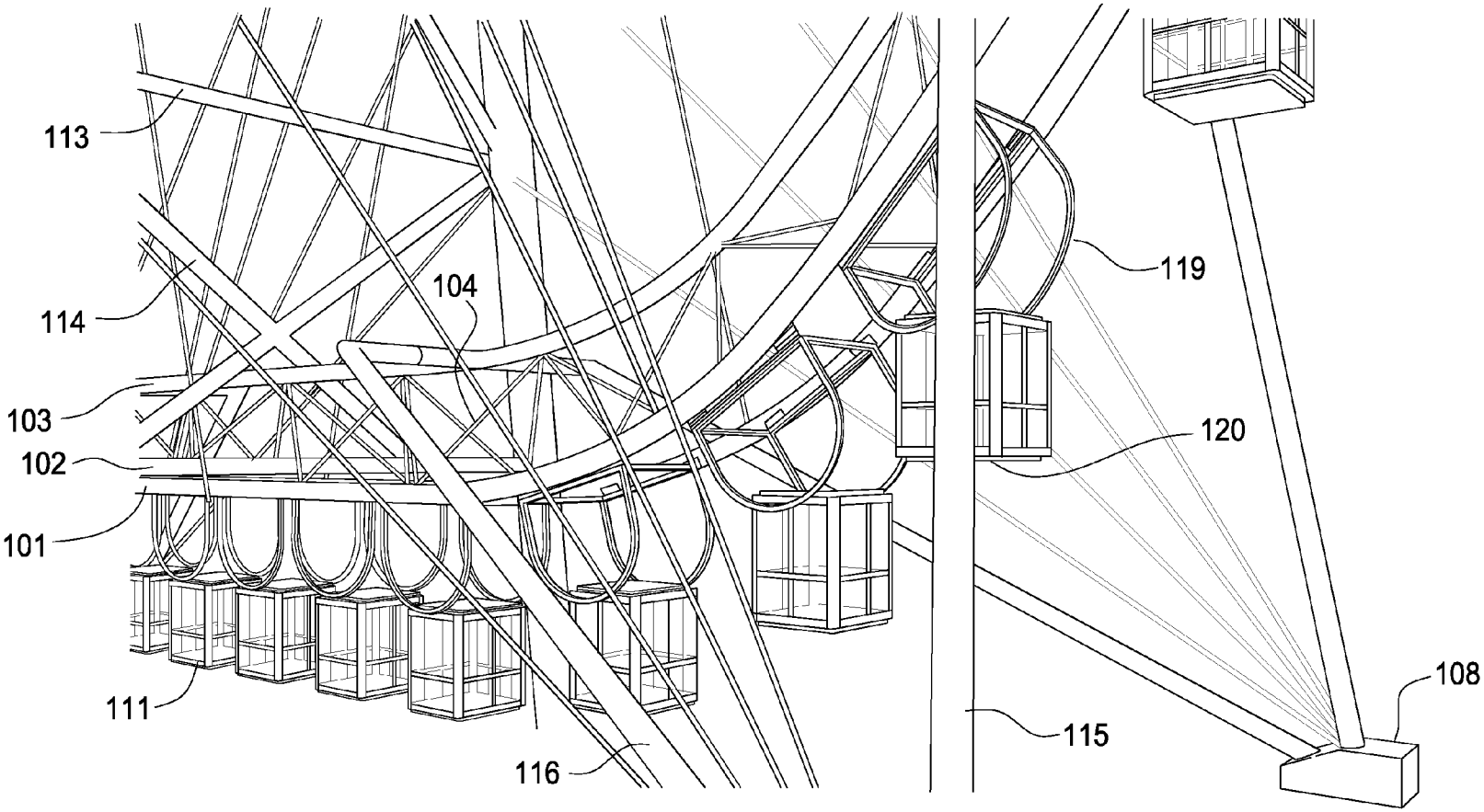
FIG. 8 is a perspective view of the bottom side of the viewing wheel with the rider carriages.

FIGS. 7 and 8 are close-up views of the rider carriages 111 on the support carriages 119 at different locations on the ride 100. These views demonstrate the rotation of the rider carriages 111 on the support carriages 119. During rotation, the floor 120 of the rider carriages 111 remains, on average, substantially level as the rider carriages traverse around the track 121. A large number of possible ways to attach the rider carriages 111 to the track 121 and to have them rotate as the rider carriage 111 move around the track exist. Any of the known or later developed means that will work with the fix track design could be used with this track 121. No limitation is intended or should be implied. The floor 120 should always remain within a range of level that reduces the chance that that the riders would fall against the sides. If desired, the floor and/or roof of the rider carriage 110 could be made at least partially of transparent material as well as the sides, as shown in the depicted embodiment.

Figure 9:
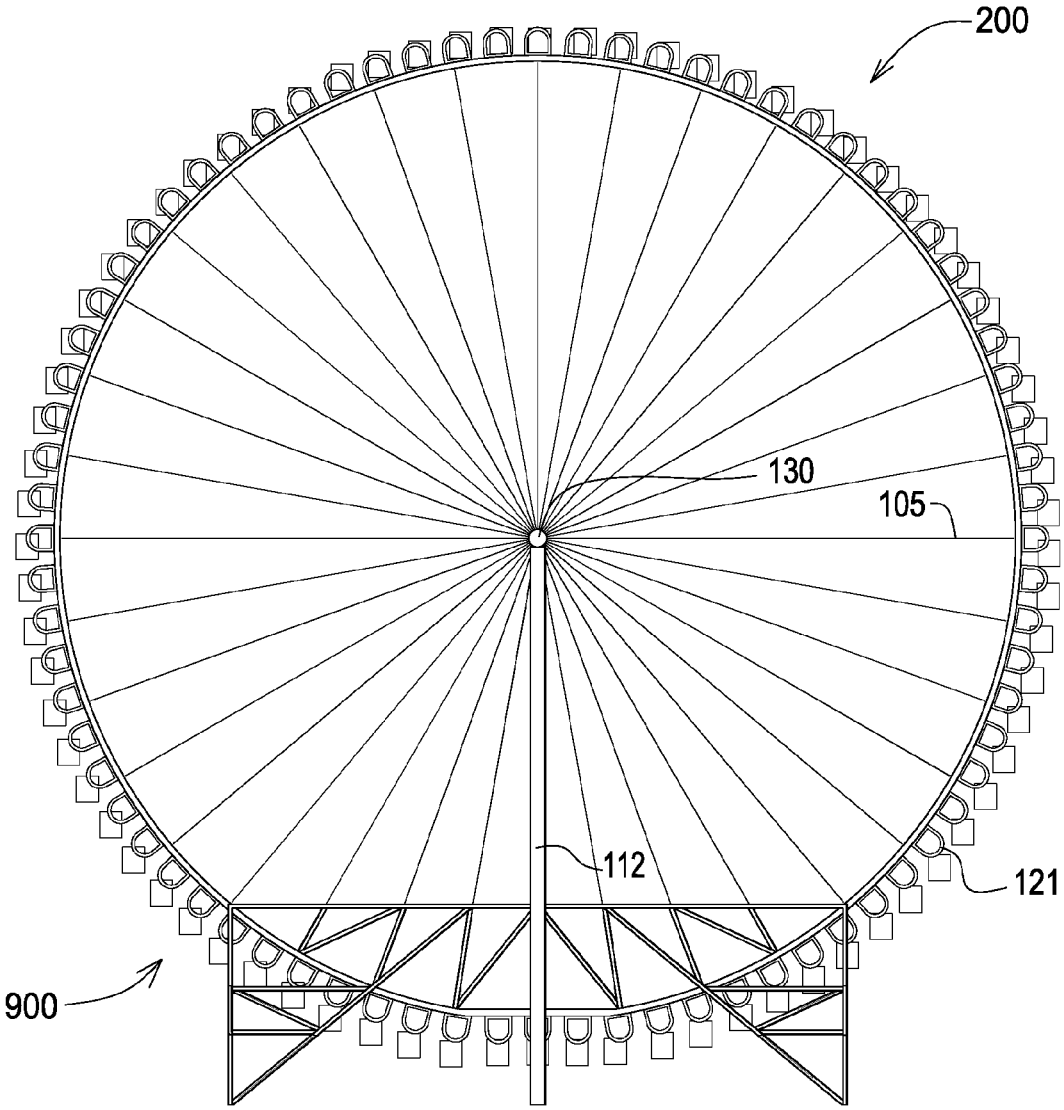
FIG. 9 is a front elevation view of an alternate embodiment of a narrow base viewing wheel.
Figure 10:
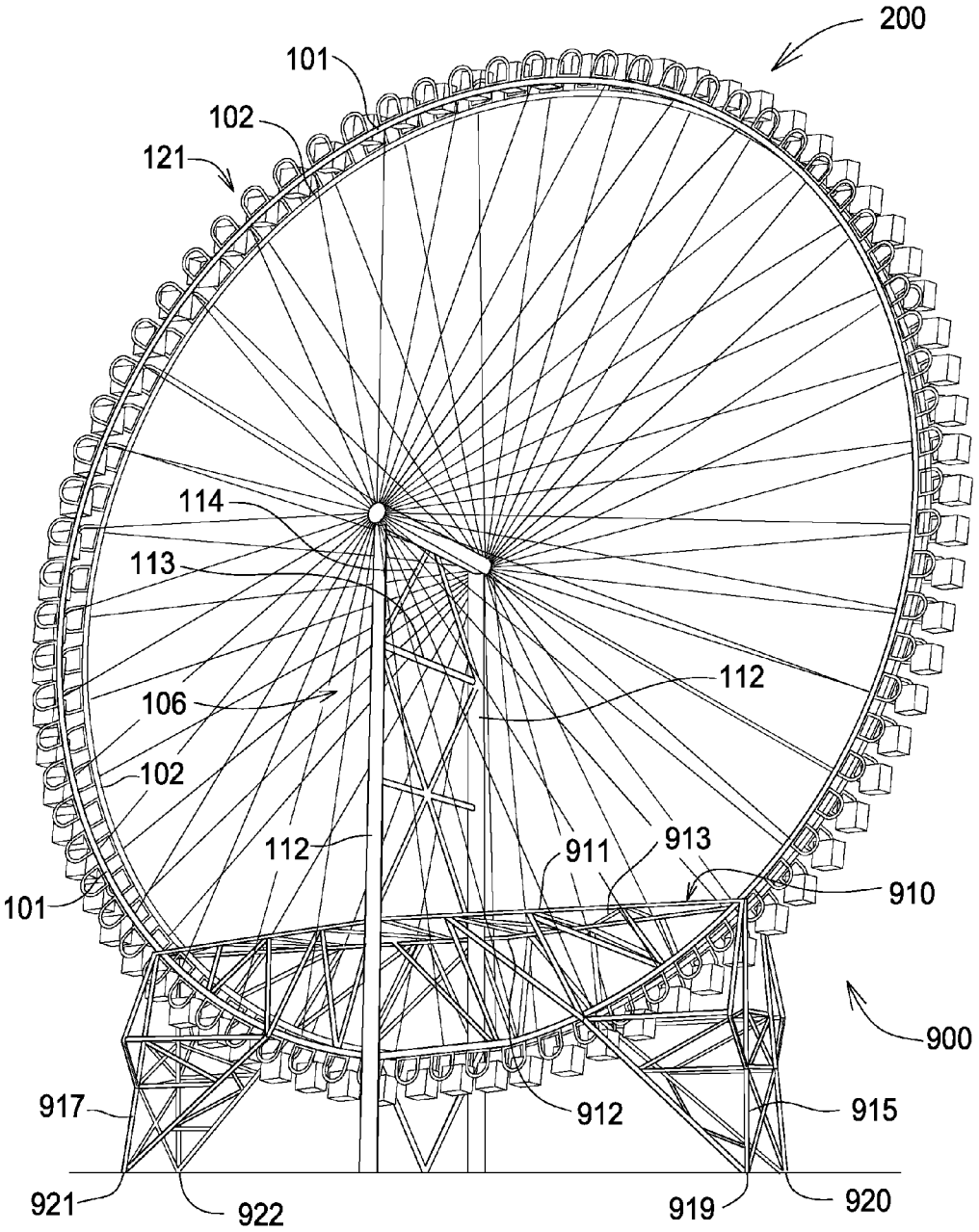
FIG. 10 is a front perspective view of the narrow base viewing wheel of FIG. 9.
Figure 11:
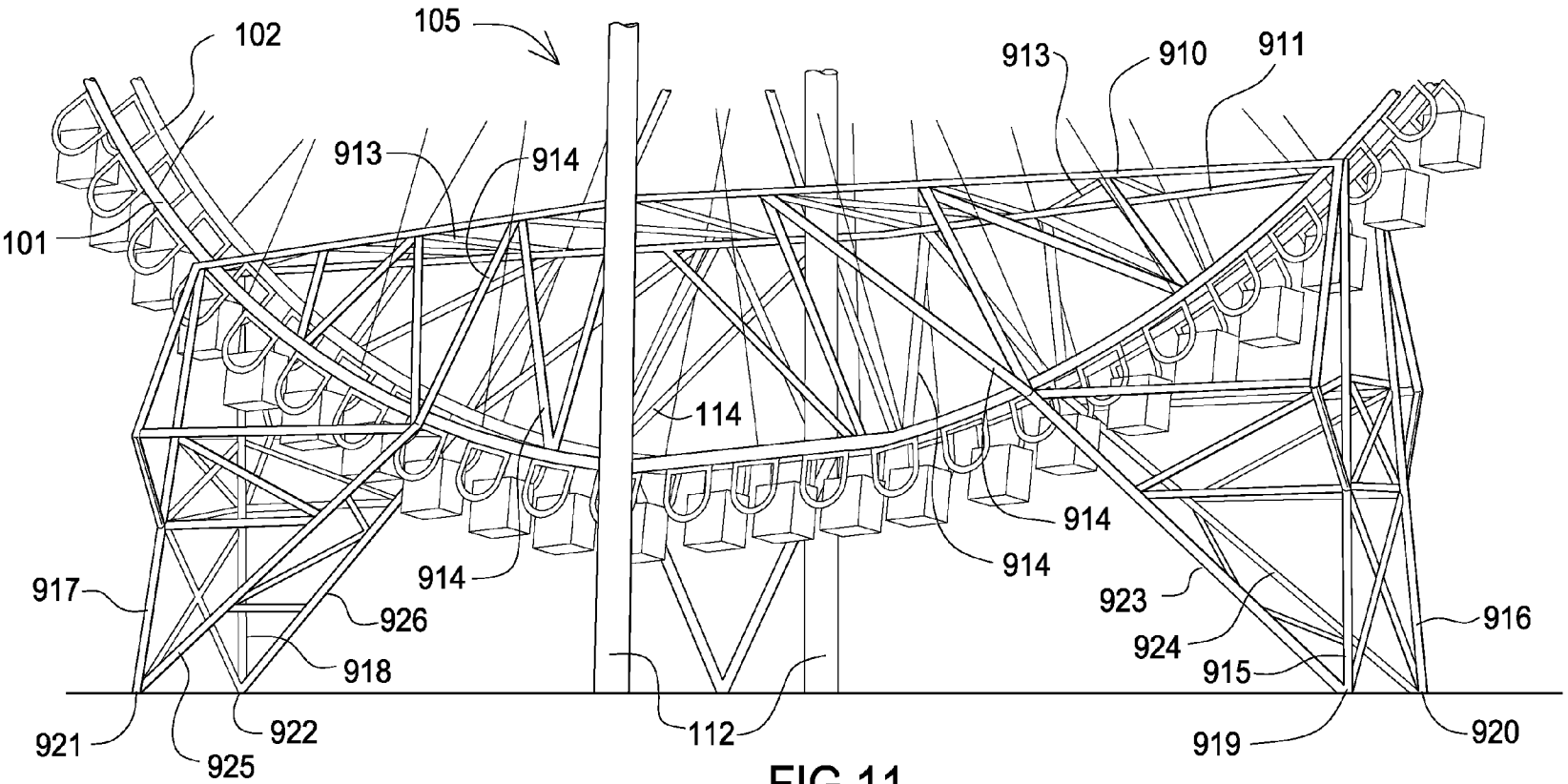
FIG. 11 is a close up of the base of the narrow base viewing wheel of FIG. 9.

Turning next to FIGS. 9, 10 and 11 an alternate embodiment of the narrow base viewing wheel 900 is depicted. In this embodiment uses a wire rope spoke configuration where the connection cables 105 are wire rope. The center frame 106 is the same as in the previous embodiment. In this embodiment the third rail is replaced by a support frame 910 with two beams 911 and 912, one on each side to form the support rail of the previous embodiment. The two beams 911 and 912 have the same function as the third rail 103 of stiffening the track and transferring the some load of the track move evenly. Beam 911 extends between carriage rail 101 to the column 112 and then on to the carriage rail 101 on the opposite side of the track 200. Beam 912 extends between carriage rail 102 to column 112 and then on to carriage rail 102 on the other side. Beams 911, 912 are approximately parallel to the ground in the depicted embodiment. Braces 913 extend between beam 911 and 912 as seen in FIG. 10. Support beams 914 extend between beams 910 and 911 and carriage rails 101, 102 respective in a bracing pattern. Supports 915, 916, 917 and 918 attach to ground anchors 919, 902, 921 and 922 respectively. Supports 915, 916 and 918 attach to the track 121 at the point that beams 910 and 911 attach, allowing the beams 910 911 to spread the load to the ground anchors. Angle beams 923, 924, 925, and 926 extend at an angle from the ground anchors towards the columns 112 and attach at approximately the midpoint between the columns 112 and the point beams 910, 911 attach to the rails 101, 102 in the depicted embodiment. Additional cross bracing between the various beam and rails is provide as needed depending on the size of the wheel and the passenger load expected.

Figure 12:
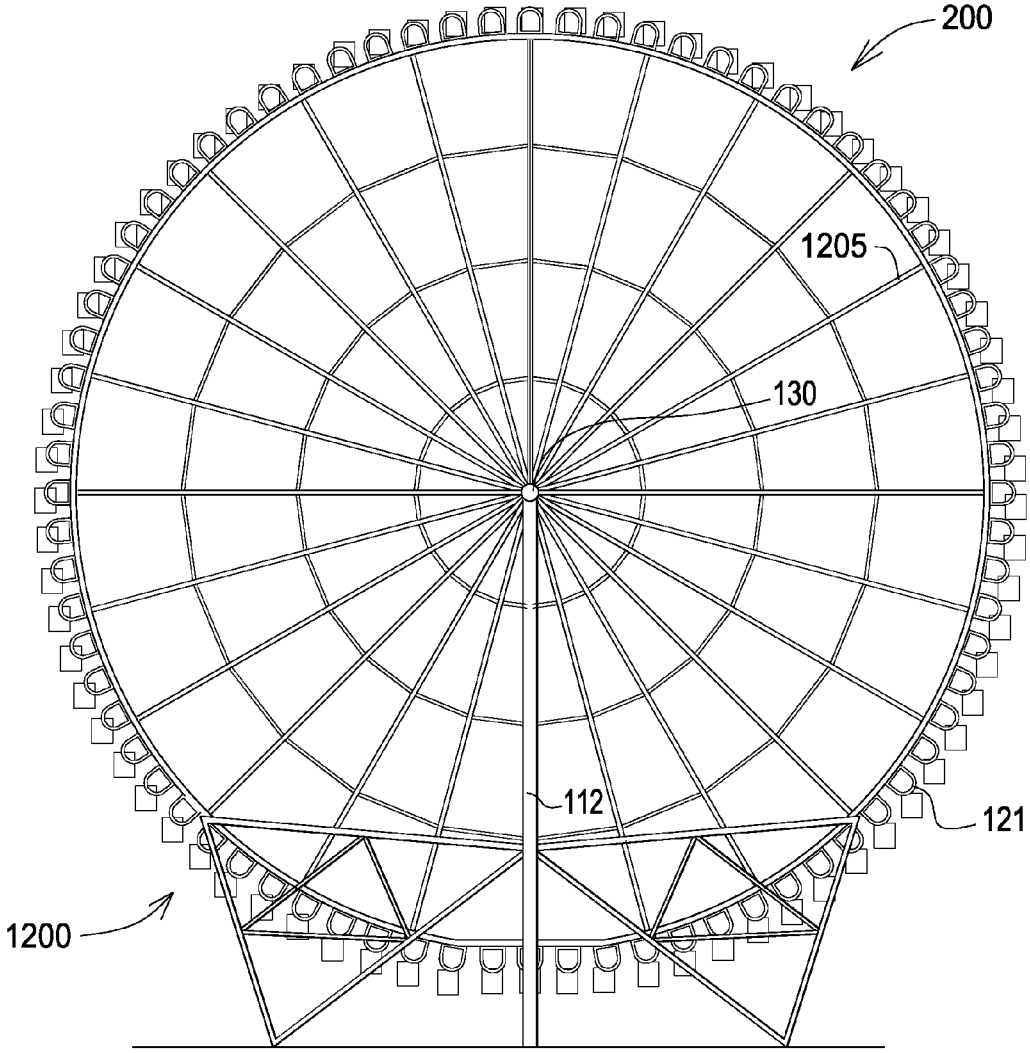
FIG. 12 is a front elevation view of a second alternate embodiment of a narrow base viewing wheel.
Figure 13:
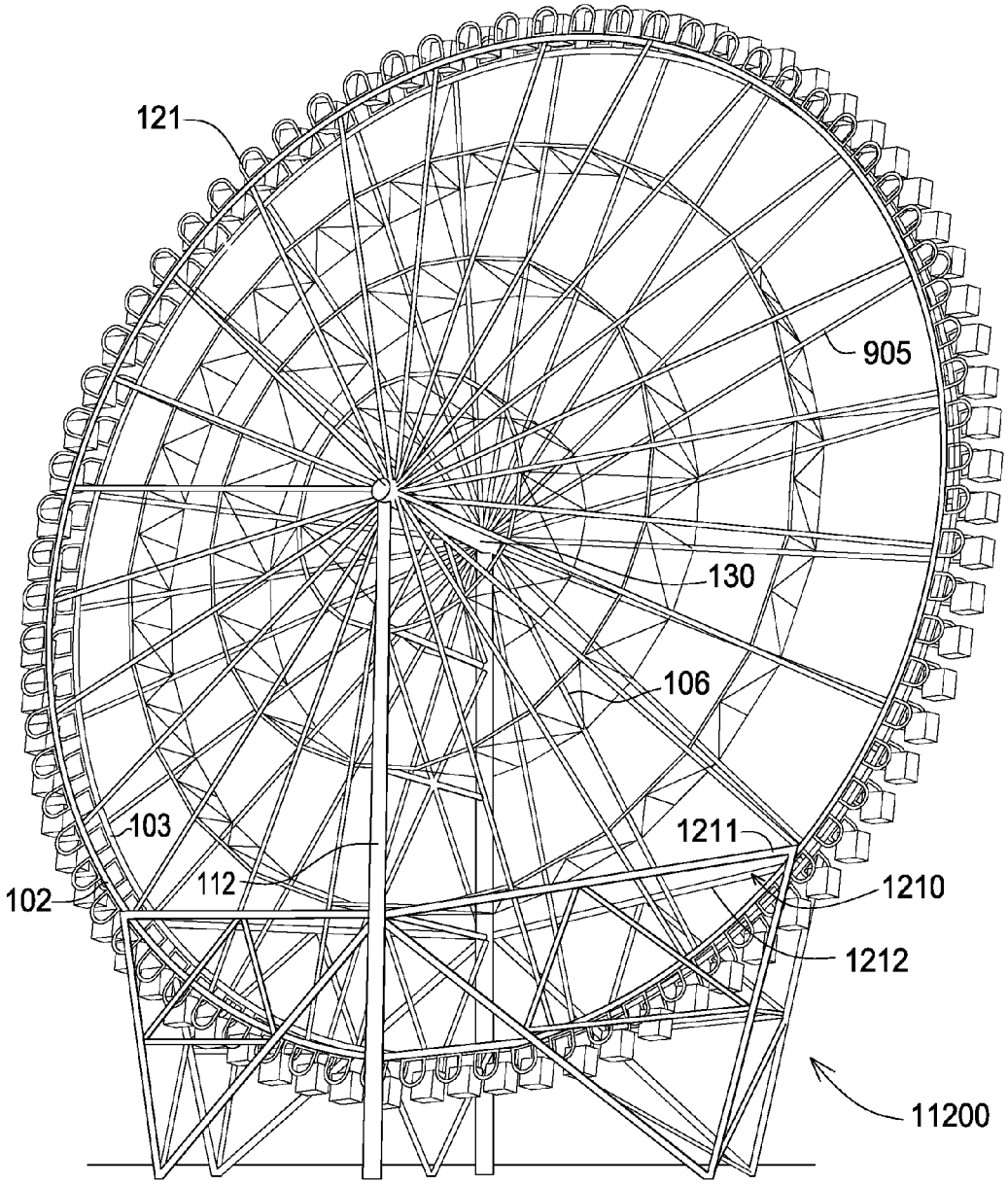
FIG. 13 is a front perspective view of the narrow base viewing wheel of FIG. 12.
Figure 14:
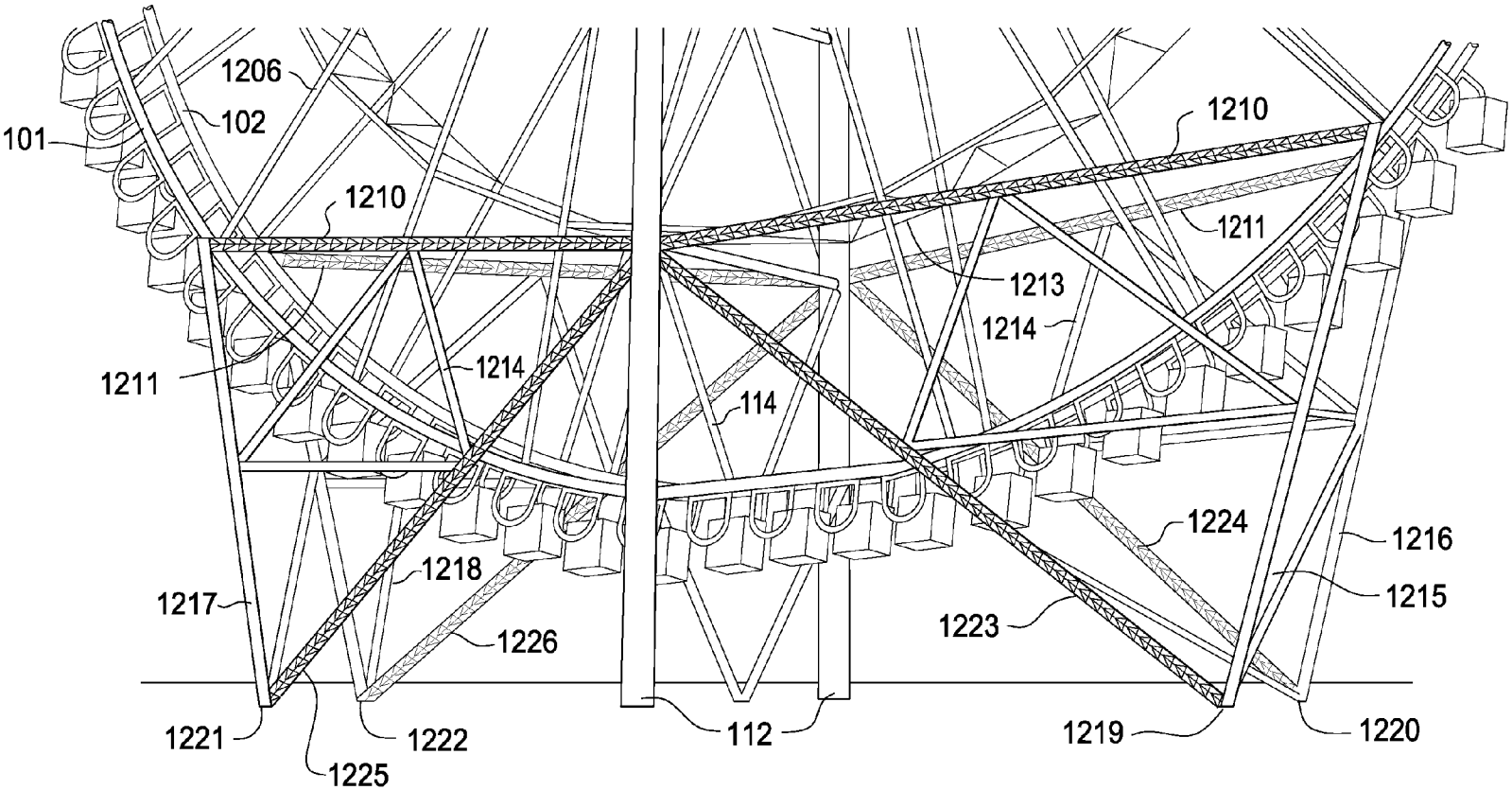
FIG. 14 is a close up of the base of the narrow base viewing wheel of FIG. 12.

Referring next to FIGS. 12, 13 and 14 the depicted embodiment of the narrow base viewing wheel 1200 uses rigid pipe spokes 1205 and bracing instead of the wire rope spokes 105 of the embodiment of FIGS. 9 through 11. This embodiment can be built with less assistance from cranes, making suitable for erection in areas that are hard to operate cranes in. The center frame 106 is the same as in the previous embodiments. In this embodiment the third rail is replaced by a support frame 1210 with two beams 1211 and 1212, one on each side forming the support rail. Beam 1211 extends between carriage rail 101 to the column 112 and then on to the carriage rail 101 on the opposite side of the track 200. Beam 1212 extends between carriage rail 102 to column 112 and then on to carriage rail 102 on the other side. Braces 1213 extend between beam 1211 and 1212 as seen in FIG. 13. Beans 1211, 1212 are approximately parallel to the ground Support beams 1214 extend between beams 1210 and 1211 and carriage rails 101, 102 respective in a bracing pattern. Supports 1215, 1216, 1217 and 1218 attach to ground anchors 1219, 1202, 1221 and 1222 respectively. Supports 1215, 1216 and 1218 attach to the track 121 at the point that beams 1210 and 1211 attach, allowing the beams 1210 1211 to spread the load to the ground anchors. Angle beams 1223, 1224, 1225, and 1226 extend at an angle from the ground anchors towards the columns 112 and attach at approximately the midpoint between the columns 112 and the point beams 1210, 1211 attach to the rails 101, 102 in the depicted embodiment. Additional cross bracing between the various beam and rails is provide as needed depending on the size of the wheel and the passenger load expected.

In the depicted embodiments, all materials not previously specified comprise steel. While steel is depicted, any material having similar strength and durability could be used.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and subcombinations possible of the group are intended to be individually included in the disclosure.

In general the terms and phrases used herein have their art-recognized meaning, which can be found by reference to standard texts, journal references and contexts known to those skilled in the art. The above definitions are provided to clarify their specific use in the context of the invention.

I claim:

1. A narrow based fixed track viewing wheel comprising:

a stationary rider track forming a closed loop;

the stationary rider track being made of at least two parallel carriage rails;

rider carriages moveably mounted on the carriage rails such that the rider carriages can move along the track for one or more circuits of the track;

the total height of the ride being at least 57 meters;

a moment frame as a center frame, the center frame having at least two columns and a top beam extending there between;

the two columns and the top beam being further connected by cross bracing; and the stationary rider track being attached to the top beam by spokes.

2. The device of claim 1 wherein the base of the two columns is the widest point of the ride.

3. The device of claim 1 further comprising signage between the columns.

4. The device of claim 1 further comprising:

a support rail extending along a portion of the lower half of the closed loop, said support rail attached to the carriage rails; and at least four footings attached to the support rail by bars extending there between, wherein the moment frame and support rail function to provide all of the support for the ride and keep the ride vertical.

5. The device according to claim 4 wherein the support rail is substantially parallel to the carriage rails.

6. The device of claim 5 further comprising bracing extending between the support rail and the carriage rails.

7. The device of claim 6 wherein the bracing extending between the support rail and the carriage rails is in a triangular configuration.

8. The device according to claim 4 wherein the support rail is substantially parallel to the ground.

9. The device of claim 8 wherein the support rail is formed of two beams extending between two points on the track located on opposing sides of the track.

10. The device of claim 9 further comprising bracing extending between the two beams.

11. The device of claim 4 wherein the footings are attached to the support rail by cross bracing.

* * * * *